United States Patent [19]

Arai et al.

[11] Patent Number: 4,706,760

[45] Date of Patent: Nov. 17, 1987

[54] FIRE EXTINGUISHING CONDITION MONITORING APPARATUS FOR AUTOMATIC FIRE EXTINGUISHING EQUIPMENT

[75] Inventors: Yoshio Arai, Sagamihara; Akira Kitajima; Kouji Akiba, both of Yokohama, all of Japan

[73] Assignee: Hochiki Kabushiki Kaisha, Tokyo, Japan

[21] Appl. No.: 810,979

[22] Filed: Dec. 19, 1985

[30] Foreign Application Priority Data

Dec. 25, 1984 [JP] Japan ..... 59-275141

[51] Int. Cl.[4] ..... A62C 37/00

[52] U.S. Cl. ..... 169/61; 340/578

[58] Field of Search ..... 169/60, 61, 26; 340/578; 250/342

[56] References Cited

U.S. PATENT DOCUMENTS

| | | | |
|---|---|---|---|
| 3,588,893 | 6/1971 | McCloskey | 169/61 |
| 4,471,221 | 9/1984 | Middleton et al. | 340/578 |
| 4,533,834 | 8/1985 | McCormack | 340/578 |

*Primary Examiner*—Andres Kashnikow
*Assistant Examiner*—Michael J. Forman
*Attorney, Agent, or Firm*—Lackenbach Siegel Marzullo & Aronson

[57] ABSTRACT

Apparatus for monitoring the fire extinguishing condition of automatic fire extinguishing equipment which is adapted to detect flames and spray a fire extinguisher liquid from a nozzle to extinguish a fire. The apparatus comprises a detector for generating a signal corresponding to the light energy radiated by the flames and a fire determination circuit for determining that the fire extinguisher liquid is hitting the flames when the detector signal has a DC component but has no AC component, since the AC component corresponds to flicker of the flame and ceases when the fire is sprayed with the fire extinguisher liquid.

3 Claims, 7 Drawing Figures

FIRE EXTINGUISHING CONDITION MONITORING APPARATUS FOR AUTOMATIC FIRE EXTINGUISHING EQUIPMENT

FIELD OF THE INVENTION AND RELEVANT ARTS

This invention relates to fire extinguishing condition monitoring apparatus for automatic fire extinguishing equipment which is adapted to detect flames generated by a fire and to spray a fire extinguishing liquid such as an extinguishing agent or water towards the flames through a nozzle to extinguish the fire.

A conventional automatic fire extinguishing equipment which detects flames due to a fire and directs a nozzle to the detected flame position to discharge a fire extinguishing liquid for extinguishing the fire, includes an infrared detector for detecting heat energy or infrared rays radiated from the flames. In such a conventional automatic fire extinguishing equipment, after fire-fighting action has been initiated, the fire extinguishing condition is monitored based on the detection signal continuously obtained from the infrared detector.

Since the infrared detector of the conventional automatic fire extinguishing equipment outputs a detection signal corresponding to the heat energy radiated from the flame, namely the intensity of the flame, a fire extinguishing condition is determined based on the disappearance of the detection signal after the extinguishing agent or water has been discharged from the nozzle. Therefore, it cannot be determined whether the extinguishing agent is surely hitting the flame or whether the detection signal has disappeared simply because the extinguishing agent has fallen to a predetermined level in the supply reservoir. Thus, there is a time lag between the initiation of the fire-fighting action and the determination of the fire extinguishing condition and a time loss before taking appropriate measure according to the fire conditions.

OBJECT AND SUMMARY OF THE INVENTION

The present invention obviates the problems described above, and it is an object of the present invention to attain rapid fire extinguishing condition determination as to whether the extinguisher liquid is surely hitting the flames or not so as to promptly cope with the fire condition.

The present invention is based on finding that the flames of a combustible gas mixture in an oxidation reaction are not static in combustion, for example like flames of a burner in a laboratory, and usually flicker due to changes in combustion speed, changes in the physical conditions of the surroundings, and the compositions of the substances being burnt.

Based on these findings, and with a view to achieving the object as described above, apparatus according to the present invention is adapted to detect the position of flames generated by a fire, direct a nozzle towards the detected position and discharge a fire extinguishing liquid thereon for extinguishing the fire. Such apparatus comprises a detector for and generating a signal corresponding to flickering change of the flames, and a fire determining circuit adapted to determine that the extinguishing liquid is hitting the flames when the A.C. component of the signal from the means for detecting the flickering becomes null. Thereby, the fire extinguishing condition is monitored on the basis of the output of the fire determining circuit.

DESCRIPTION OF PREFERRED EMBODIMENT OF THE INVENTION

Figure 1:
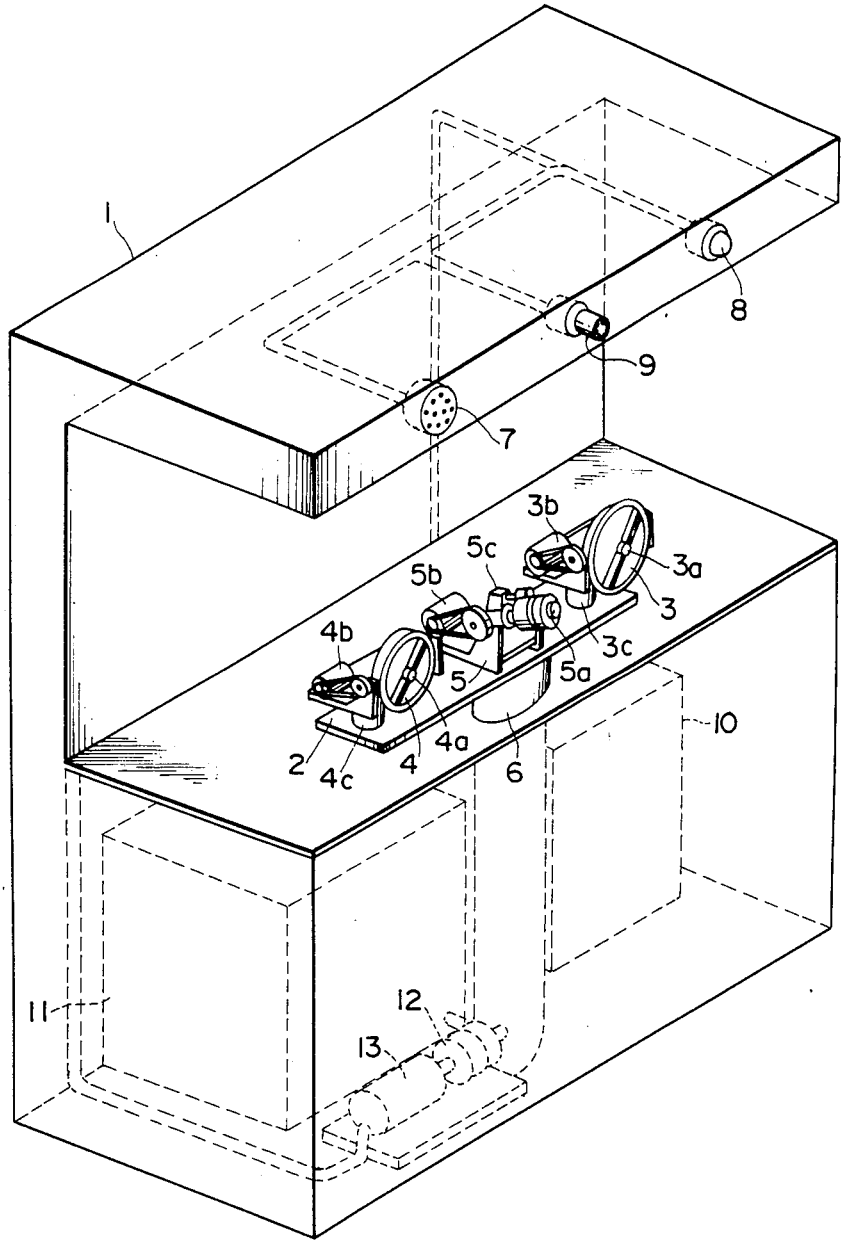
FIG. 1 is a perspective view of an entire structure of one embodiment of the present invention.

Referring now to the drawings, there is illustrated one embodiment of the present invention.

Figure 2:
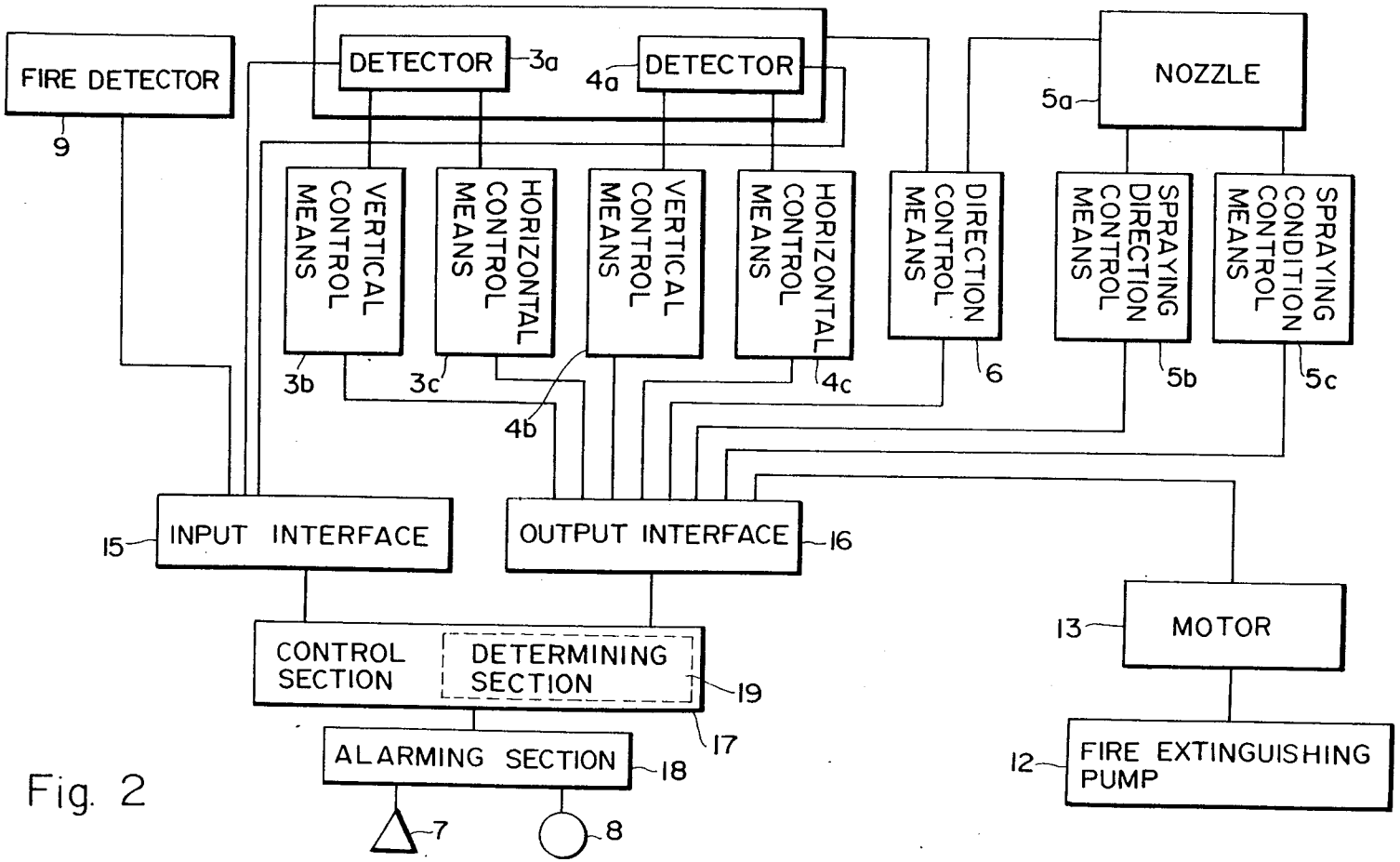
FIG. 2 is a block diagram of the embodiment illustrated in FIG. 1.
Figure 6:
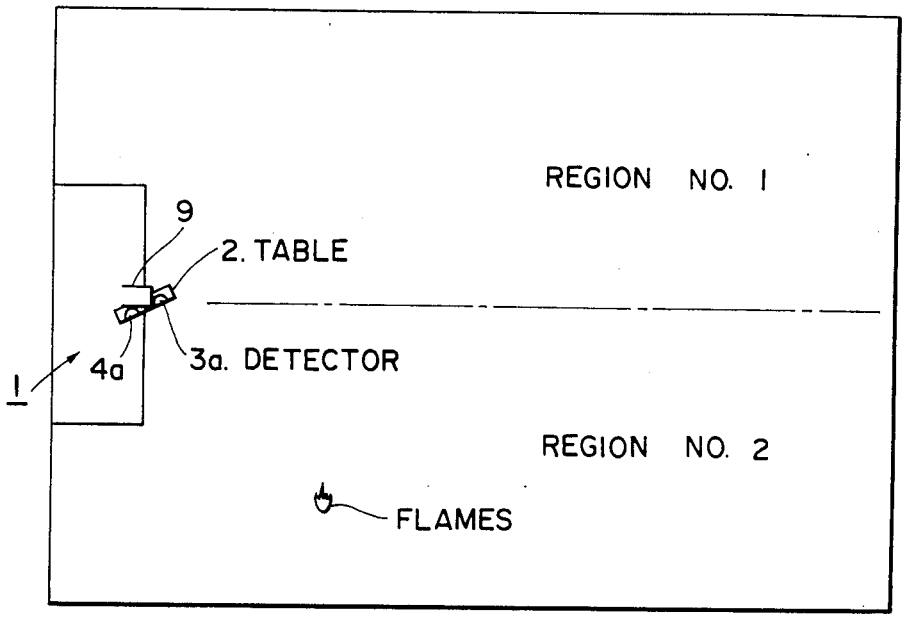
FIG. 6 is a plan view showing monitoring zone.

In FIGS. 1 and 2, 1 is an automatic fire extinguishing equipment and a pair of fire source detecting apparatuses 3 and 4 are disposed on a table 2, keeping a distance therebetween. One of the fire source detecting apparatuses 3 comprises a detector 3*a* for detecting a fire source, a vertical control means 3*b* for controlling the detector 3*a* in the vertical direction, and a horizontal control means 3*c* for controlling the detector 3*a* in the horizontal direction. Another fire source detecting apparatus 4 similarly comprises a detector 4*a* for detecting a fire source, a vertical control means 4*b* for controlling the detector 4*a* in the vertical direction and a horizontal control means 4*c* for controlling the detector 4*a* in the horizontal direction. The vertical control means 3*b*, 4*b* and the horizontal control means 3*c*, 4*c* each separately control the corresponding detectors 3*a*, 4*a*, respectively, so as to drive the detectors 3*a*, 4*a* in the vertical direction and in the horizontal direction in response to an instruction from a control section as will be described in detail later for detecting the position of the fire source. 5 is a nozzle assembly disposed around a rotational center of the table 2 and it comprises a nozzle 5*a* for spraying fire extinguishing liquid, a spraying direction control means 5*b* for directing the nozzle 5*a* towards the fire source position detected by the fire source detecting apparatuses 3, 4, and a spraying condition control means 5*c* for controlling the spraying condition by adjusting the opening degree of the spout of the nozzle 5*a* according to the distance to the fire source. 6 is a direction control means for controlling the rotation of the table 2 in the horizontal direction so as to direct the fire source detecting apparatuses 3, 4 and the nozzle assembly 5 conjointly towards the fire source. 7 is a buzzer and 8 is a lamp. As a detecting means for detecting a flickering change of the flames started in an monitoring zone, there is provided a fire detector 9. The fire detector 9 includes, as detecting devices, for example, two photodiodes which respectively monitor regions No. 1 and No. 2 divided in the monitoring zone as illustrated in FIG. 6. When either of the detecting devices included in the fire detector 9 detects a fire, a detection signal based of a flickering change of a light energy from the flames is output to a circuitry section 10. 11 is a tank for reservoiring a fire extinguisher liquid such as an extinguisher agent or water, 12 is a pump for feeding the fire extinguisher liquid from the tank 11 to the nozzle 5*a*, and 13 is a motor.

Figure 5:
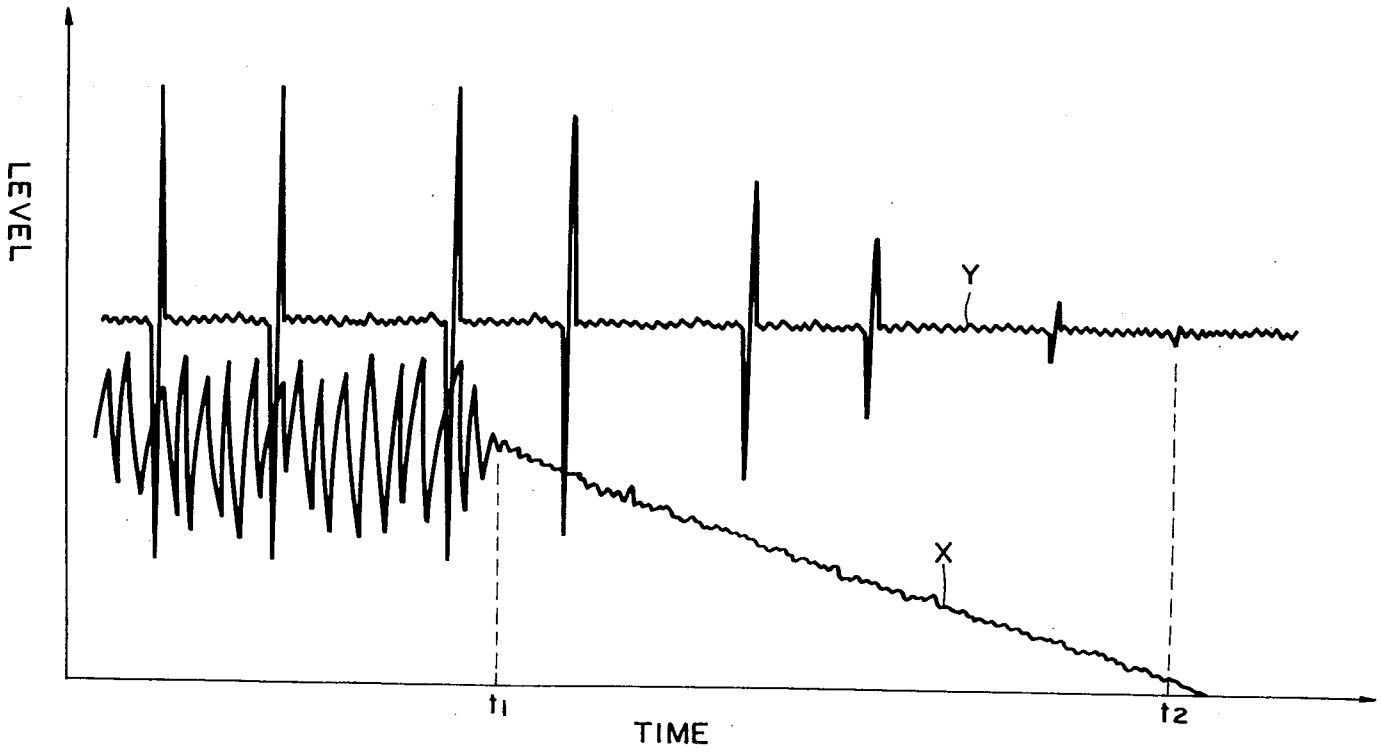
FIG. 5 is a graph showing changes of detection signals.

In FIG. 5, X indicates a detection signal from the fire detector 9 and Y indicates a detection signal from the detector 3*a* which is representatively shown among the detection signals from the detectors 3*a*, 4*a*. The detection signal X from the detector 9 is formed of a portion which contains a DC component and AC components and a portion which contains only a DC component. In the former portion, the AC component is indicative of a flickering change by the flame and it is that portion which indicates whether the extinguisher liquid is hitting the flames. The detectors 3*a*, 4*a* each use, as detecting devices, pyroelectric elements so as to detect near-infrared rays contained in the light radiated from the flames. More particularly, several peaks appearing in the graph Y indicates outputs obtained when the flames come in views of the detectors 3*a*, 4*a* which are rotated in the horizontal direction and the lowering tendency of the signal level shows that the flames are being extinguished.

In this respect, the detection signal from the fire detector 9 is input to the control circuit 17 through an input interface 15. The control circuit 17 makes a fire determination on the basis of the detection signal from the fire detector 9 and when the control circuit 17 determines it is a fire, it gives an alarming section 18 an instruction to actuate the buzzer 7 and the lamp 8 for providing an alarm indication and to drive the direction control means 6 so as to direct the fire source detecting apparatuses 3, 4 and the nozzle assembly 5 towards a center of a fire starting area. The control circuit 17 contains various means for implementing various programs such as a control program, computing program, etc. by using a microcomputer. As will be described in detail later, the vertical direction control means 3*b*, 4*b* and the horizontal direction control means 3*c*, 4*c* are controlled according to the preset control program so that each of the fire source detecting apparatuses 3, 4 may carry out a detection operation on a fire source with respect to each of the regions of the fire starting area allocated thereto, respectively. Upon input of the dectection signals from the fire detecting apparatuses 3, 4, the control circuit 17 computes the position of the fire source by a trigonometrical survey. According to the result of the computation, the direction control means 6 is again controlled to rotate the table 2 so as to direct the fire source detecting apparatuses 3, 4 and the nozzle assembly 5 conjointly towards the fire source position. When the motor 13 is actuated by an instruction from the control circuit which is obtained through an output interface 16, the fire extinguishing pump 12 is driven and fire extinguisher liquid is supplied to conduct a fire-fighting action. After initiation of the fire-fighting action, the fire detector 9 functions as a detecting means for detecting the fire extinguishing condition based on a flickering change of the flames and outputs a detection signal corresponding to the fire extinguishing condition to the control circuit 17 through the input interface 15. The control circuit 17 includes a fire determination section 19 for monitoring the fire extinguishing condition after initiation of the fire-fighting action, based on the presence or absence of the detection signal or the flickering portion of such signal from the fire detector 9. More particularly, after actuation of the fire extinguishing pump 12, if the extinguisher liquid discharged from the nozzle 5*a* is hitting the flames, the flames ceases wavering, so that the flickering signal component from the fire detector 9 becomes null. Thus, the determination section 19 makes a determination as to whether the fire extinguishing is surely effected or not, based on the presence or absence of the signal from the fire detector 9 representing the flickering change and controls the fire-fighting action according to the result of the determination.

Figure 3:
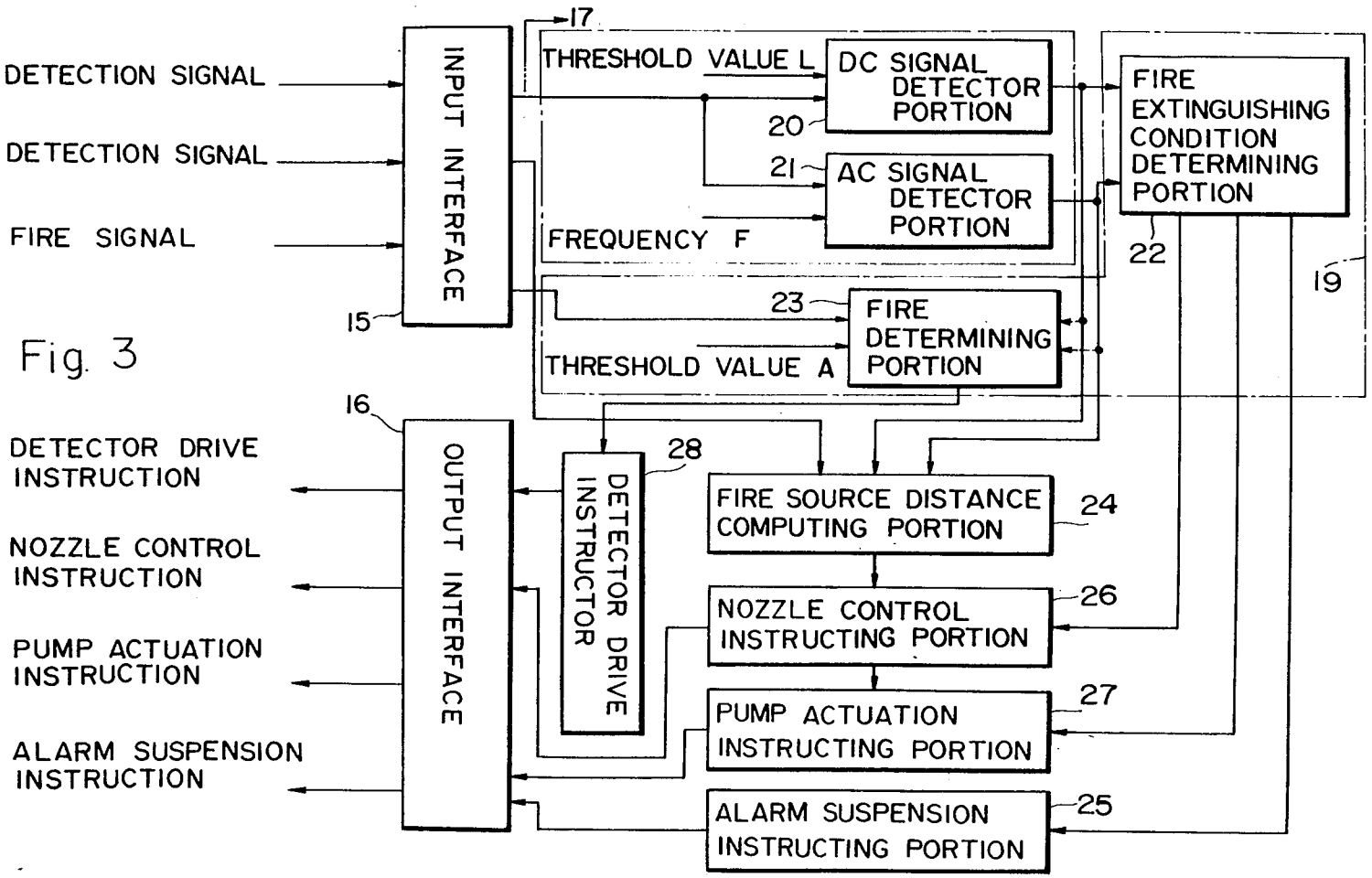
FIG. 3 is a detailed block diagram of a control section shown in FIG. 2.

The control circuit 17 and the determination section 19 are as illustrated in FIG. 3. The control circuit 17 comprises, as specific means for detecting the flickering of the flames, a DC signal portion 20 and an AC signal portion 21 which are connected in parallel with each other. It further comprises a fire extinguishing condition determining portion 22 and a fire determining portion 23 which constitute the determination circuit 19. The control section 17 further comprises a fire source distance computing portion 24 for computing the distance to the fire source, and an alarm suspension instructing portion 25, a nozzle control instructing portion 26, a pump actuation instructing portion 27 and a detector drive instructing portion 28 which are connected to the various portions of the control section to generate various instruction signals.

More particularly, If the fire detector 9 detects flames in either of the monitoring regions, the detection signal having a waveform as shown by X in FIG. 5 is input, as a fire detection signal, to the control section 17 through the input interface 15. The fire determining portion 23 compares the input signal with a preset threshold value A and determines if it is a fire or not. When the input signal exceeds the threshold value A, the the fire determining portion 23 determines it is a fire and actuates the detector drive instructing portion 28 to drive the detectors 3*a*, 4*a* through the output interface 16. The detection signals from the detectors 3*a*, 4*a* are input to the fire source distance computing portion 24 through the input interface 15.

On the other hand, the detection signal from the fire detector 9 is supplied to the DC signal detector portion 20 and the AC signal detector portion 21 and where it is divided into a DC component and an AC component. The DC signal detector portion 20 generates an output when the input signal exceeds a threshold value L and the AC signal detector portion 21 generates an output when the input signal is within a predetermined frequency range f, for example from 0.2 to 10 Hz. Both of the outputs from the signal detector portions 20, 21 are input to the fire extinguishing conditions determining portion 22 and the fire source distance computing portion 24.

The fire extinguishing condition determining portion 22 determines the fire extinguishing condition based on the input signals from the signal detector portions 20, 21. The contents of the determination is as shown in the following table:

| | | | |
|---|---|---|---|
| DC component | O | O | X |
| AC component | O | X | X |
| | Fire | Being extinguished | Extinguished |

O: detected
X: not detected

The signals from the DC and AC signal detector portions 20, 21 are input to the fire source distance computing portion 24 and become an actuating signal for the fire source distance computing portion 24. The fire source distance computing portion 24 only initiates the computation when the fire determining portion 23 determines a fire. The inputs are supplied from the detectors 3a, 4a and the input signal from the fire detector 9 is detected to contain both the DC and AC components by the detector portions 20, 21 to output a signal. The contents of the computation is a computation of the location of the fire source by the trigonometrical survey as described before.

An output signal from the fire extinguishing portion 22 and an output signal from the fire source distance computing portion 24 are input to the nozzle control instructing portion 26. The nozzle control instructing portion 26 outputs signals to the spraying direction control means 5b, spraying condition control means 5c and the direction control means 6 through the output interface 16.

An output signal from the fire extinguishing condition determining portion 22 and an output signal from the nozzle control instructing portion 27 are input to the pump actuation instructing portion 27 and a pump actuation instructing signal is conveyed to the motor 13 through the output interface 16 to actuate the fire extinguishing pump 12.

The fire extinguishing condition determining portion 22 generates an output to the alarm suspension instructing portion 25 when it determines the fire has been extinguished and an instruction to suspend the alarm is conveyed to the alarming section 18 through the output interface 16 to suspend the operation of the buzzer 7 and the lamp 8.

The operation of the apparatus as illustrated will now be described in time system referring to FIGS. 4(A) and (B).

Figure 4A:
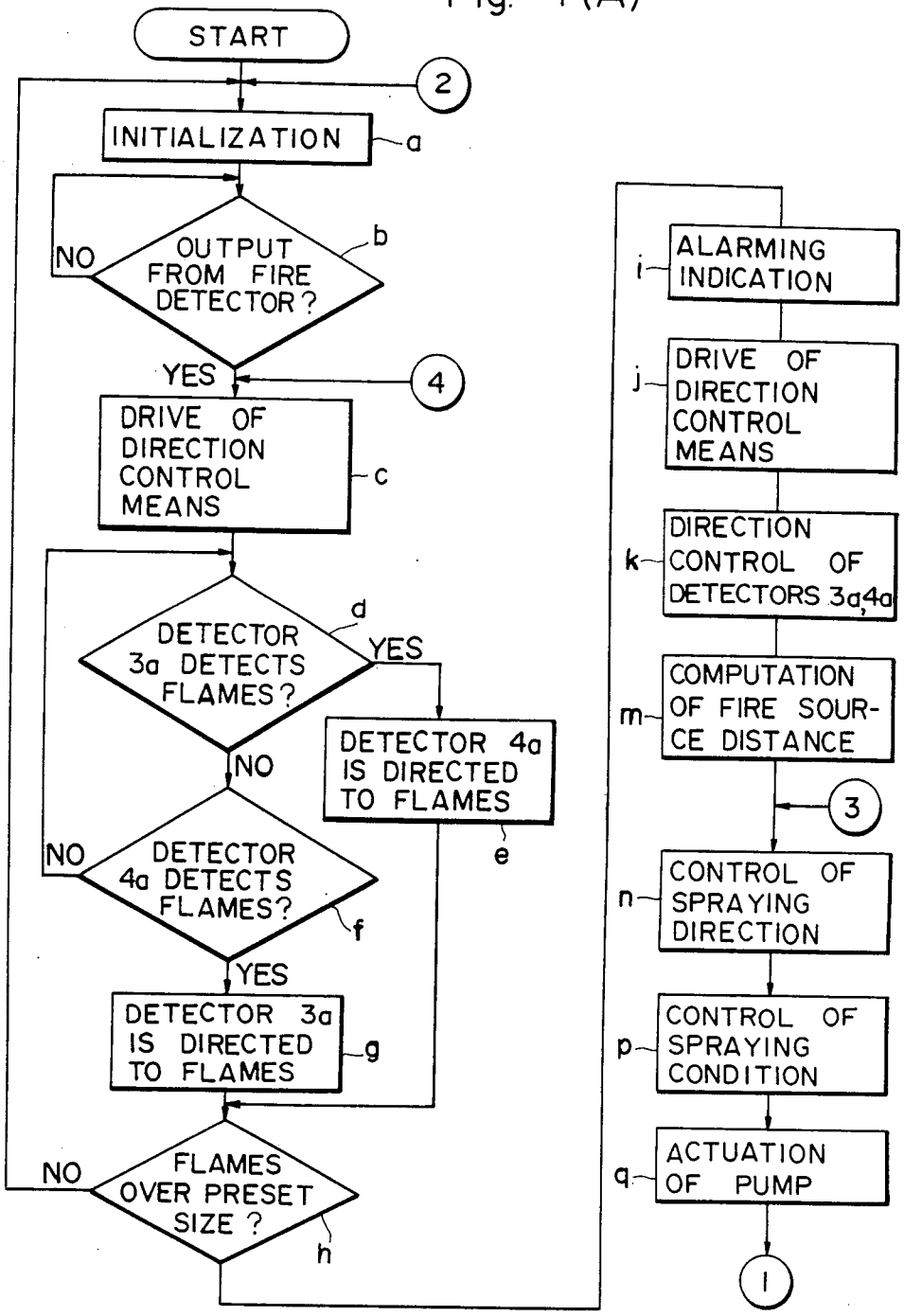
FIGS. 4(A) and (B) are each a flowchart of a control operation.
Figure 4:
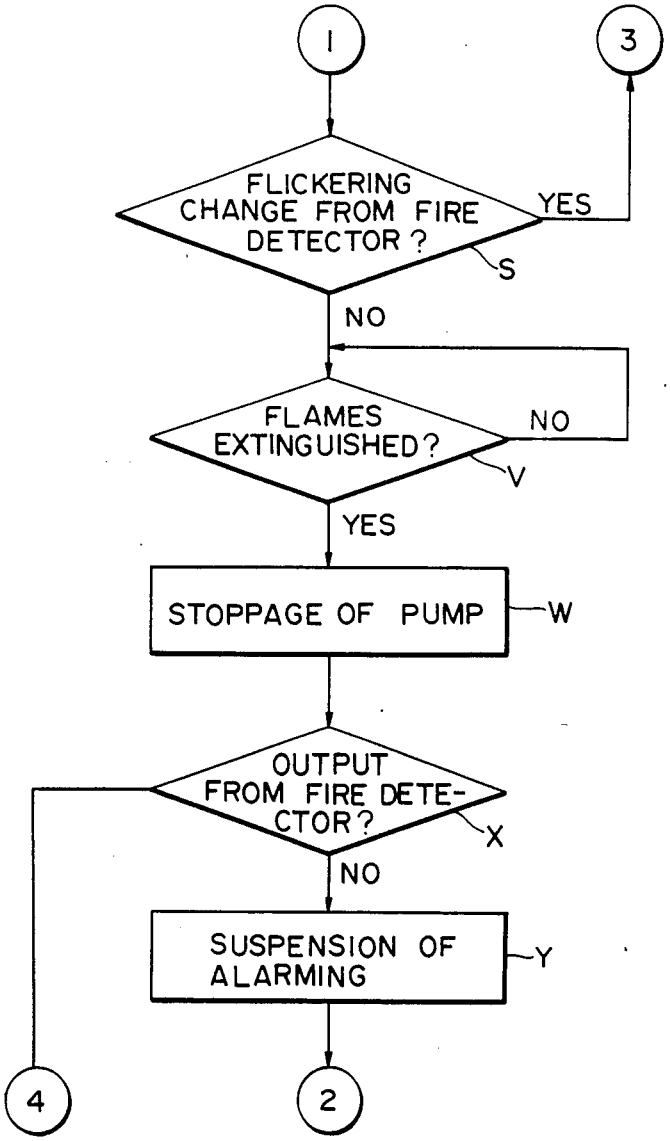

In FIG. 4(A), an initialization for a normal time is set at block a. For example, the horizontal direction control means 3c, 4c and the direction control means 6 are controlled to adjust the rotational angle of the table 2 so as to conjointly direct the detectors 3a, 4a and the nozzle 5a conjointly forward. The angle of the detector 3a in the vertical direction is directed vertically downward and the angle of the detector 4a in the vertical direction is directed to substantially the center of the monitoring zone. At block b, the fire detector 9 monitors occurrence of a fire for each monitoring region and in the event that a fire has started at the monitoring region No. 2, the fire detector 9 detects flickering of flames due to the fire and the step proceeds from block b to c to drive the direction control means 6. Upon driving of the direction control means 6, the table 2 is rotated in the horizontal direction so that the detectors 3a, and 4a and the nozzle 5a are conjointly directed towards the region No. 2 and flame detection is instructed to the detectors 3a, 4a. More particularly, since the angle of the detector 3a in the vertical direction is set in the vertically downward direction and the angle of the detector 4a is set in the direction towards the center of the region No. 2, when the horizontal direction control means 3c, 4c are driven, the detectors 3a, 4a scan in the horizontal direction within the region No. 2 while keeping the initial angle in the vertical direction. At block d, it is determined whether the detector 3a detects flames or not and if flames are not detected, the step proceeds to block f to read the detection signal from the detector 4a. If the flame detection signal is not obtained at block f, the step returns to block d to drive the vertical direction control means 3b, 4b so that the vertical angles of the detectors 3a, 4a are turned upwardly by a predetermined angle, while keeping the driving of the horizontal direction control means 3b, 4b to scan within the region No. 2 in the horizontal direction.

Thereafter, the vertical angles of the respective detectors 3a, 4a are further turned upward by the predetermined angle and the scanning in the horizontal direction within the region No. 2 keeping the vertical angles is effected. These flame detection operations are repeated. In these operations, if the detector 3a detects flames, the step proceeds from block d to block e to drive the vertical direction control means 4b so as to direct the detector 4a towards the flame. At block h, the size of the flames is determined based on the signal from the fire detector 9. If the size of the flames is under a predetermined size, it is not determined as being a fire and the step returns to block a to be reset to the initialization for further monitoring of fire occurrence. If the size of the flames is larger than the predetermined size, it is determined as being a fire and the step proceeds to block i to sound the buzzer 7 and to light the lamp 8 for giving an alarm indication. More specifically, when the output signal from the fire detector 9 is larger than the threshold value A, the fire determining portion 23 determines a fire. Alternatively, as shown by broken lines in FIG. 3, the output signals from the DC signal detector portion 20 and the AC signal detector portion 21 may be input to the fire determining portion 23 so that fire determination may be made only when the output signal from the fire detector 9 exceeds the threshold value A, the DC component of the signal also exceeds the threshold value L and the AC component thereof representing the flickering of the flames is within the predetermined frequency range f. The step is further advanced to block j where the direction control means 6 is driven to control the rotation of the table 2 so that the fire detecting apparatuses 3, 4 may be conjointly directed towards the flames. At block k, re-adjustment may be effected because the direction angles of the detectors 3a, 4a are deviated from the flames according to the rotation of the table 2. For this purpose, the horizontal control means 3c, 4c are operated to direct the detectors 3a, 4a towards the flames. At block m, the detection signals are obtained in a state where the detectors 3a, 4a face the flames and an accurate position of the flames, i.e. a distance to the flames and a height of the flames is computed based on the detection signals from the detectors 3a, 4a. The nozzle assembly 5 is controlled according to the result of the computation and at block n, the spraying direction control means 5b is operated to control the angle of the nozzle 5a in the vertical direction so as to direct the spout thereof towards the flames. At block p, the spraying condition control means 5c is operated to adjust the opening degree of the spout of the nozzle 5a so as to control the fire extinguisher liquid spraying condition. At block q, the motor 13 is actuated to operate the fire extinguishing pump 12 and discharge the fire extinguisher liquid from the nozzle 5a for initiating the fire-fighting action. The step proceeds from block q to ①. In FIG. 4(B), the step proceeds from ① to block s to monitor the fire extinguishing condition. More specifically, when the AC signal representing the flickering change is continuously obtained, the step proceeds to block n and block p of FIG. 4(A) through ③ to re-adjust the spraying direction control means 5b and the spraying condition control means 5c for continuing the fire-fighting action.

When the fire-fighting action is initiated at time t1 and if the fire extinguisher liquid sprayed from the nozzle 5a is surely hitting the flames as shown in FIG. 5, the AC signal is no more obtained from the fire detector 9. At block s of FIG. 4(B), when the AC signal becomes null, it is determined that the fire-fighting action is surely effected and the step proceeds from block s to block v. At block v, whether the fire has been extinguished or not is determined based on the intermittent detection data obtained by the horizontal scanning of the detectors 3*a*, 4*a* as shown by Y of FIG. 5. If the fire has not been completely extinguished, above steps are repeated till the fire is extinguished. When the levels of the detection signals from the detectors 3*a*, 4*a* at time t2 are lowered to below the predetermined level as shown in FIG. 5, it is determined at block v of FIG. 4(B) that the flames have been extinguished and the step proceeds to block w. At block w the fire extinguishing pump 12 is stopped. At block x, it is determined whether leaping of the flames has occurred in the direction other than the horizontal direction or not. More specifically, if an AC signal from the fire detector 9 is obtained, it is determined that the flames have leaped in a direction other than the horizontal direction and the step proceeds to block c of FIG. 4(A) through ④ to instruct the detection of the leaped flames and the series of the operations until fire extinction.

On the other hand, if a signal output from the fire detector 9 is not obtained at block x, the step proceeds to block y to turn off the buzzer 7 and the lamp 8 for ceasing the alarming, and the step again returns to block a of FIG. 4(A) through ② so as to be reset to the initialization for further fire monitoring.

Although the fire detector 9 includes a light receiving diode as a detecting means for detecting the flickering change of the flames in the embodiment as illustrated, another type of detecting means such as a sensor which detects a flickering change of light energy from the flames, or a sensor which detects a flickering change of infrared rays from the flames, e.g. a solar cell, a photo transistor and a infrared sensor, may alternatively be employed.

Further, in the above mentioned embodiments, spraying of fire extinguishing liquid is started at the same time of starting of the fire extinguishing pump 12. However a solenoid valve can be employed to control the spraying action of the spray nozzle as the ordinal pump system employed. In this case, sequential action of start and stop of the extinguishing pump 12 and the solenoid valve will be shown in FIGS. 4A, 4B as follows. That is, new block is inserted between block q and ① at which the spray nozzle is opened by an action of the solenoid valve, contents of block w in FIG. 4B is changed to a stop action of the spray nozzle by the solenoid valve and a new block which shown a stop action of the fire extinguishing pump 12 is inserted between block y and ② in FIG. 4B.

More further, in the above mentioned embodiments, only the fire detector 9 is used for detection of the flickering fire. However the detector 3*a*, and 4*a* of the fire source detecting apparatuses 3 and 4 can be employed for the detection of the flickering of the fire as same to the fire detector 9. In this case, a solar cell, a photo transistor, a photo diode and a infrared sensor can be employed for the detector 3*a*, and 4*a*.

We claim:

1. Apparatus for monitoring the fire extinguishing condition produced by automatic fire extinguishing equipment which detects flames due to a fire and sprays a fire extinguisher liquid from a nozzle to extinguish the flames, such monitoring apparatus comprising:

a detector for generating a signal corresponding to the light energy radiated by the flame;

a fire determination circuit including means for determining the fire extinguishing condition based on the signal from said detector;

said fire determination circuit comprising a portion which detects a DC component of the detector signal which corresponds to flicker in the light energy emitted by the flame and a portion which detects an AC component of such signal which corresponds to flicker in the light energy emitted by the flame and determining that the fire extinguisher liquid is hitting the flames when the detector signal has a DC component but has no AC component after spraying of the fire extinguishing liquid.

2. Monitoring apparatus as claimed in claim 1, wherein said fire determination circuit further determines that the flame has been extinguished when the detection signal has neither said DC component nor said AC component.

3. Monitoring apparatus as claimed in claim 2, wherein said detector comprises at least one photodiode responsive to the light energy radiated by the flame to produce said signal.

* * * * *